US009182205B2

(12) United States Patent
Sitz

(10) Patent No.: US 9,182,205 B2
(45) Date of Patent: Nov. 10, 2015

(54) UNIVERSAL HOLDER FOR A CLIP OR MAGAZINE FOR A FIREARM

(71) Applicant: Justin Sitz, Bryan, TX (US)

(72) Inventor: Justin Sitz, Bryan, TX (US)

( * ) Notice: Subject to any disclaimer, the term of this patent is extended or adjusted under 35 U.S.C. 154(b) by 0 days.

(21) Appl. No.: 13/900,242

(22) Filed: May 22, 2013

(65) Prior Publication Data

US 2013/0270311 A1 Oct. 17, 2013

Related U.S. Application Data

(63) Continuation-in-part of application No. 13/066,269, filed on Apr. 11, 2011.

(51) Int. Cl.

| | |
|---|---|
| ***F41C 33/02*** | (2006.01) |
| ***F42B 39/00*** | (2006.01) |
| ***F41A 23/18*** | (2006.01) |
| ***F42B 39/08*** | (2006.01) |
| ***F42B 39/22*** | (2006.01) |
| ***F42B 39/26*** | (2006.01) |

(52) U.S. Cl.

CPC ..... *F42B 39/00* (2013.01); *F41A 23/18* (2013.01); *F41C 33/0245* (2013.01); *F42B 39/08* (2013.01); *F42B 39/22* (2013.01); *F42B 39/26* (2013.01)

(58) Field of Classification Search

CPC ..... F41A 9/63; F42B 39/00; F42B 39/02; F42B 39/22

USPC ..... 224/239, 243, 255, 247, 248, 268, 272, 224/666, 904, 931; 206/3

See application file for complete search history.

(56) References Cited

U.S. PATENT DOCUMENTS

| | | | | |
|---|---|---|---|---|
| 1,166,781 | A * | 1/1916 | Parrish | 224/193 |
| 1,768,177 | A | 6/1930 | Wanee | |
| 2,401,174 | A | 5/1946 | McAuley | |
| 2,758,762 | A * | 8/1956 | Medley | 224/243 |
| 2,764,326 | A | 9/1956 | Stanton | |
| 2,765,107 | A | 10/1956 | Browning | |
| 2,951,622 | A | 9/1960 | Heim | |
| 3,353,728 | A | 11/1967 | Freed | |
| 3,642,184 | A | 2/1972 | Hendricks | |
| 3,796,358 | A | 3/1974 | Grubb | |
| 3,938,717 | A | 2/1976 | Theodore | |
| 4,022,361 | A | 5/1977 | Devlin | |
| 4,120,109 | A | 10/1978 | Musgrave | |
| 4,442,962 | A | 4/1984 | Musgrave | |

(Continued)

OTHER PUBLICATIONS

Young, Lee W., "Patent Cooperation Treaty International Search Report and Written Opinion dated Jun. 15, 2012", PCT Application No. PCT/US12/00153, Patent Cooperation Treaty, Jun. 15, 2012.

(Continued)

*Primary Examiner* — Adam Waggenspack
(74) *Attorney, Agent, or Firm* — Lindauer Law, PLLC

(57) ABSTRACT

Holders for retaining a container for ammunition can include a first portion configured for attachment to a surface, a second portion extending from the first portion, and an insertable member extending from the second portion. The insertable member can be adapted for insertion into the interior of a container for ammunition. To prevent relative movement between the container for ammunition and the first portion, friction can be created between the container and the holder through contact between the insertable member and the container or contact between the body of the holder and the container.

37 Claims, 4 Drawing Sheets

(56) References Cited

U.S. PATENT DOCUMENTS

| | | | | | |
|---|---|---|---|---|---|
| 4,483,089 | A | * | 11/1984 | Johnson | 42/89 |
| 4,580,363 | A | | 4/1986 | Rowe, Jr. | |
| 4,597,213 | A | | 7/1986 | Musgrave | |
| 4,667,374 | A | | 5/1987 | Bianchi | |
| 4,928,876 | A | * | 5/1990 | Marshall | 229/103.1 |
| 5,081,709 | A | | 1/1992 | Benyo et al. | |
| 5,167,355 | A | | 12/1992 | Hill | |
| 5,322,297 | A | | 6/1994 | Smith | |
| 5,358,160 | A | | 10/1994 | Bianchi | |
| 5,472,317 | A | | 12/1995 | Field et al. | |
| 5,584,423 | A | | 12/1996 | Wang | |
| 5,611,471 | A | | 3/1997 | French | |
| 5,622,297 | A | | 4/1997 | Rogers et al. | |
| 5,624,064 | A | * | 4/1997 | McGee, Jr. | 224/414 |
| 5,749,507 | A | | 5/1998 | Wood | |
| 5,806,739 | A | | 9/1998 | Wood | |
| 5,855,305 | A | | 1/1999 | Nichols | |
| 6,003,207 | A | | 12/1999 | Homma | |
| 6,398,089 | B1 | | 6/2002 | Har-Shen | |
| 6,668,479 | B1 | | 12/2003 | Obong | |
| 6,829,855 | B2 | | 12/2004 | Seifert | |
| 7,314,152 | B1 | | 1/2008 | Garrett | |
| 8,006,424 | B1 | | 8/2011 | Ligard | |
| 8,533,876 | B2 | | 9/2013 | Bonk | |
| 2009/0229292 | A1 | | 9/2009 | Sweeney | |
| 2009/0321480 | A1 | * | 12/2009 | Kincaid et al. | 224/243 |
| 2010/0264177 | A1 | | 10/2010 | Clifton, Jr. | |
| 2012/0260554 | A1 | | 10/2012 | Huffines | |

OTHER PUBLICATIONS

Waggenspack, Adam J., "Final Office Action dated May 21, 2013", U.S. Appl. No. 13/066,269.

Waggenspack, Adam J., "Non-Final Office Action dated Jan. 4, 2013", U.S. Appl. No. 13/066,269.

Waggenspack, Adam J., "Non-Final Office Action dated Dec. 5, 2014", U.S. Appl. No. 13/066,269.

Waggenspack, Adam J., "Final Office Action dated May 6, 2015", U.S. Appl. No. 13/066,269, The United States Patent and Trademark Office, May 6, 2015.

Waggenspack, Adam J., "Advisory Action, dated Aug. 21, 2015", U.S. Appl. No. 13/066,269, The United States Patent and Trademark Office, Aug. 21, 2015.

Waggenspack, Adam J., "Non-final Office Action dated Aug. 14, 2015", U.S. Appl. No. 14/134,955, The United States Patent and Trademark Office, Aug. 14, 2015.

Waggenspack, Adam J., "Non-final Office Action dated Jul. 28, 2015", U.S. Appl. No. 13/987,603, The United States Patent and Trademark Office, Jul. 28, 2015.

* cited by examiner

UNIVERSAL HOLDER FOR A CLIP OR MAGAZINE FOR A FIREARM

CROSS-REFERENCE TO RELATED APPLICATIONS

The present application is a continuation-in-part application, which claims priority to the co-pending United States application for patent having the application Ser. No. 13/066,269, filed Apr. 11, 2011, which is incorporated by reference herein in its entirety.

FIELD

Embodiments usable within the scope of the present disclosure relate, generally, to holders for retaining containers, and more specifically, to holders adapted to engage, secure, and/or otherwise retain clips, magazines, or similar containers used to hold ammunition for firearms.

BRIEF DESCRIPTION OF THE DRAWINGS

In the detailed description of various embodiments usable within the scope of the present disclosure, presented below, reference is made to the accompanying drawings, in which.

Figure 2:
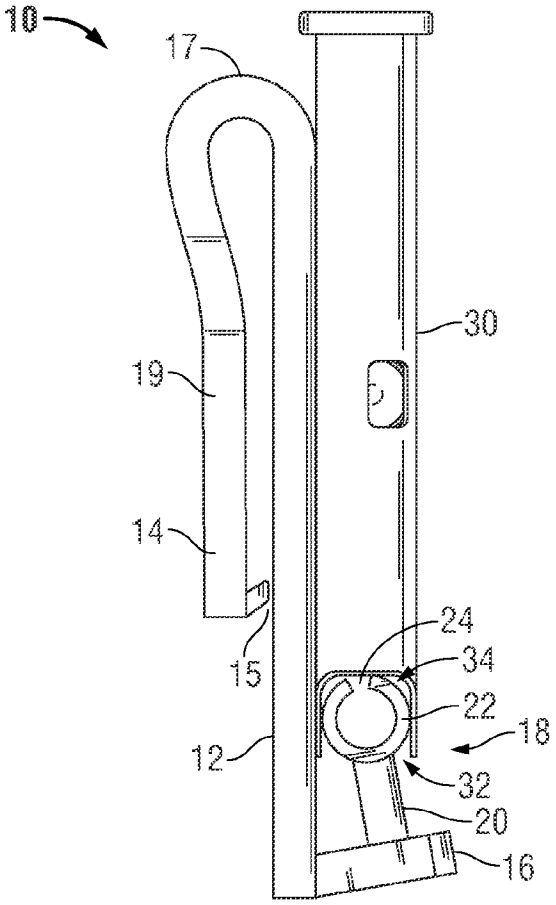
FIG. 2 depicts the holder of FIG. 1 engaged with a container for ammunition.

One or more embodiments are described below with reference to the listed Figures.

DETAILED DESCRIPTION OF THE EMBODIMENTS

Before describing selected embodiments of the present invention in detail, it is to be understood that the present invention is not limited to the particular embodiments described herein. The disclosure and description herein is illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended to illustrate and plainly disclose presently preferred embodiments of the invention to one of skill in the art, but are not intended to be manufacturing level drawings or renditions of final products and may include simplified conceptual views as desired for easier and quicker understanding or explanation of the invention. As well, the relative size and arrangement of the components may differ from that shown and still operate within the spirit of the invention as described throughout the present application.

Moreover, it will be understood that various directions such as "upper", "lower", "bottom", "top", "left", "right", and so forth are made only with respect to explanation in conjunction with the drawings, and that the components may be oriented differently, for instance, during transportation and manufacturing as well as operation. Because many varying and different embodiments may be made within the scope of the inventive concept(s) herein taught, and because many modifications may be made in the embodiments described herein, it is to be understood that the details herein are to be interpreted as illustrative and non-limiting.

Embodiments usable within the scope of the present disclosure relate to holders usable to retain, secure, and/or engage containers for ammunition for firearms (e.g., clips, magazines, and/or similar containers). The terms "clip," "magazine," and "container for ammunition" may be used interchangeably herein; however, it should be understood that embodiments usable within the scope of the present disclosure can be used with any type of container or similar body configured for containing ammunition for a firearm, independent of the form, features, or characteristics thereof.

When it is desirable for a user of a firearm to conveniently carry additional ammunition, e.g., in the form of a spare magazine or clip, conventional methods for doing so include carrying the container for ammunition loosely (e.g., in a pocket or bag), using some manner of strap or containment mechanism to attach the container to the exterior of a firearm (e.g., to or within the hilt or buttstock), or wearing a specialized "holster," sized and shaped to contain a specific type of clip or magazine. Because conventional methods either lack convenience (e.g., by failing to retain a container for ammunition in an easily accessible location), or require specialized components sized and shaped to interact with the external features of a clip or magazine, which can vary extensively depending on the manufacturer and type thereof, a need exists for a universal holder, able to engage, secure, and/or retain a wide variety of containers for ammunition independent of the exterior features thereof, by engaging the interior of a container for ammunition (e.g., a chamber of a magazine or clip normally occupied by a bullet, round, and/or cartridge), which will be generally identical among every clip and magazine designed to hold ammunition of the same or similar caliber. A holder that does not require physical structure to accommodate the external features of a container for ammunition can have a minimum of bulk, facilitating ease of manufacture and reducing cost, while also providing a minimal profile that is more readily concealable than conventional alternatives. Embodied holders that do not require physical structure to accommodate the external features of a container for ammunition can also generally be worn ambidextrously, on either side of a user's body, and can selectively be worn internal of or external to a user's belt and/or pants or other lower body garment.

Embodiments usable within the scope of the present disclosure can generally include a body having a first portion adapted for attachment to a surface (e.g., a clip for attachment to an article of clothing, or other features and/or fasteners suitable for mounting to the underside of a bar, table, or other item of furniture, or to the interior of a vehicle, including without limitation, adhesives, Velcro™ or similar hook-and-loop fasteners, brackets, clips, clamps, clasps, bolts, rivets, screws, nails, etc.), and a second portion having an insertable member extending therefrom. The insertable member can be sized for insertion into the interior of a container for ammunition. For example, in one embodiment, the insertable member can include a circular, ring-shaped, curved, and/or cylindrical element that can be passed through an exterior opening in a clip or magazine to enter an internal space normally occupied by ammunition (e.g., by longitudinal insertion along the axis of the chamber in the container for ammunition). Contact between the exterior of the insertable member and the interior of the container can facilitate retention thereof. In other embodiments, the insertable member can include a compressible element, such as a split-ring structure (e.g., a circular or cylindrical body having a gap to allow compression of the body to a smaller diameter by narrowing the width of the gap). The insertable member can thereby be passed through an exterior opening in a clip or magazine to enter an internal space normally occupied by ammunition, then allowed to expand and/or otherwise contact the interior of the clip or magazine. Depending on the type of clip or magazine to be retained, a single bullet/round/cartridge can be removed therefrom to provide a space accessible by the insertable member.

The insertable member can be removed from a container for ammunition using the same method by which it is inserted. As such, embodiments usable within the scope of the present disclosure can enable a container for ammunition to be secured to a holder, and removed therefrom, using two possible methods: longitudinal insertion of an insertable member into a space within the container in a manner that may not require compression thereof; and compression of the insertable member to enable passage through an exterior opening in the container (whether inserting the insertable member into the container or removing the container from the holder for use).

Other embodiments can include an insertable member having a curved and/or semi-circular shape that is thereby able to be compressed (e.g., by moving the ends of the curved shape toward one another) for passage through an exterior opening in a clip or magazine (e.g., when removing the clip or magazine therefrom). Due to the curved shape of the insertable member lacking structure that would occupy the central portion of a space normally occupied by ammunition, a bullet/round/cartridge can occupy the internal chamber of the clip or magazine unimpeded by the presence of the insertable member, such that no removal of a bullet/round/cartridge is required to accommodate the insertable member.

While in many cases, insertion of the insertable member into the interior of a container for ammunition may be sufficient to retain the container in association with the holder, embodiments usable within the scope of the present disclosure can further secure the container by creating friction between the container and the body of the holder. For example, in an embodiment, the insertable member can be angled toward the body, such that contact between the insertable member and an interior surface of the container for ammunition biases the container against the body to create friction therebetween for preventing relative movement between the container and the body. One or more portions of the holder can be formed from a bendable material (e.g., plastic, rubber, or similar materials) that can be manually deformed but has a tendency to return to its original shape, to facilitate positioning of the insertable member in a manner that facilitates insertion thereof into the interior of a clip or magazine. Once the insertable member has been inserted into the container for ammunition, the tendency of the material to return to its original shape can cause the insertable member to apply a force against the interior of the container to urge the container against the body of the holder, effectively "clamping" a portion of the container for ammunition between the insertable member and the body of the holder. To facilitate subsequent disengagement of a clip or magazine from the holder, the bendable material can be flexed to reduce or eliminate contact between the clip or magazine and the body of the holder.

Alternatively or additionally, the body can include a protruding member extending therefrom that contacts an exterior surface of the container for ammunition to limit relative movement between the container and the holder. The contact between the container and the protruding member can simply brace and/or restrict movement of the container, or in an embodiment, contact between the container and the protruding member can create friction therebetween. For example, a protruding member formed from a compressible material could be compressed by contact with the exterior of the container such that the protruding member applies a force against the container to create friction and prevent relative movement between the container and the holder body. Further, in various embodiments, the body can include a frictional member disposed thereon that contacts an exterior surface of the container for ammunition to create friction therebetween. For example, a frictional surface on the body can serve to prevent relative movement between the body and the container, or a ferromagnetic element (e.g., a magnet) can bias (e.g., attract) the container against the body to create friction therebetween.

Figure 1:
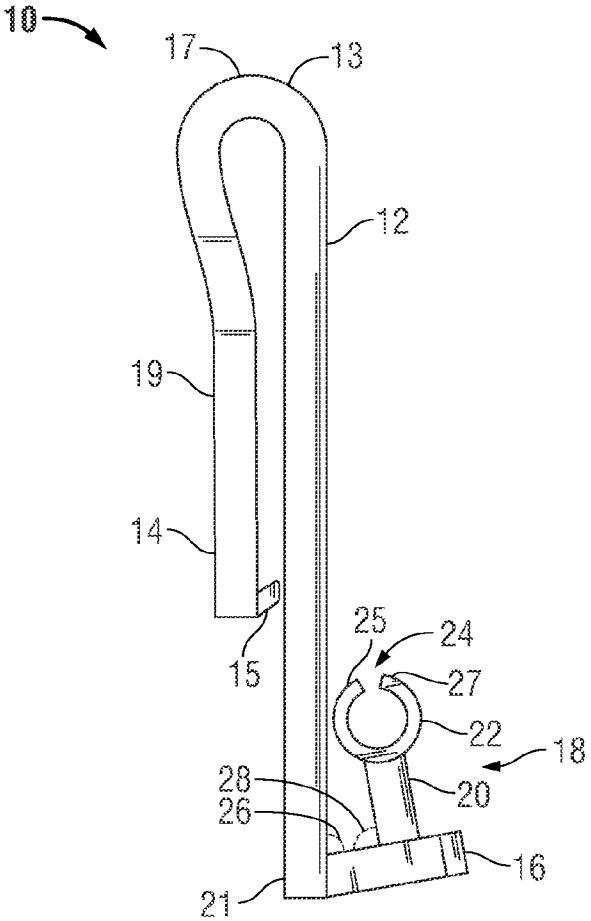
FIG. 1 depicts a side view of an embodiment of a holder usable within the scope of the present disclosure.

FIG. 1 depicts a side view of an embodiment of a holder (10) usable within the scope of the present disclosure. The depicted embodiment includes a first portion (12), shown as a generally vertical plate and/or similar member, having a clip (14) or similar type of fastener extending from a first side thereof. Specifically, the clip (14) is shown extending from the upper end (13) of the first portion (12), having a curved portion (17) engaged with the first portion (12), a straight portion (19) extending from the curved portion (17) parallel to and spaced apart from the first portion (12), and a crimped portion (15) at the distal end thereof that is shown contacting the back side of the first portion (12). The straight portion (19) and first portion (12) thereby define a space therebetween. In use, the clip (14) can be engaged with an article of clothing of a user; for example, a belt or similar article can be placed within the space between the straight portion (19) and first portion (12), while the crimped portion (15) and curved portion (17) serve as the upper and lower bounds of the space, such that the belt or similar article is prevented from inadvertent removal from the space. Alternatively or additionally, the clip (14) can be placed over a waistline of a user's pants, a collar or cuff of a shirt or boot, or any other portion of an article of clothing, and the crimped portion (15) can serve to pinch, trap, and/or clamp a portion of the article of clothing between the crimped portion (15) and the back side of the first portion (12). For example, if one or more portions of the holder are formed from a bendable material (e.g., plastic, rubber, or similar materials) that can be manually flexed but has a tendency to return to its original shape, the presence of a portion of an article of clothing between the crimped portion (15) and first portion (12) can slightly bend the clip (14), such that the tendency of the material to return to its original shape will cause the crimped portion (15) to apply a force against the article of clothing, urging it against the back side of the first portion (12).

A second portion (16), e.g., a generally horizontal plate and/or similar member, is shown extending from the lower end (21) of the first portion (12) at a first angle (26). The second portion (16) is depicted having an insertable member (18) extending therefrom at a second angle (28). While the specific shape, configuration, and dimensions of the insertable member (18) may vary without departing from the scope of the present disclosure, and any member having at least a portion adapted for insertion into an interior space of a container for ammunition could be used with embodiments of the present holder, FIG. 1 depicts the insertable member (18) having a spacing element (20), shown as a rod or similar elongate member, extending between the second portion (16) and an insertion element (22) associated with the end thereof. The spacing element (20) can serve to space a container for ammunition a desired distance away from the body of the holder (10) and/or can be partially or wholly inserted into a clip or magazine to position the insertion element (22) at a desired location in the interior of the clip or magazine. In an embodiment, the spacing element (20) can be adjustable (e.g., using telescoping members, one or multiple removable members, one or more spring-biased members, or other similar adjustable members) to position the insertion element (22) a desired distance from the first and/or second portions (12, 16) of the holder (10) and/or to position the insertion element (22) as desired relative to a container for ammunition.

While it should be understood that any member having at least one dimension less than a dimension of an exterior opening in a container for ammunition, or able to be compressed in at least one direction to provide the member with at least one dimension less than a dimension of the exterior opening in the container, can function as an insertable member within the scope of the present disclosure, the depicted embodiment shows the insertion element (22) as a split-ring structure, e.g., a generally cylindrical body having a gap (24) between a first portion (25) of the split-ring structure and a second portion (27) thereof.

By way of example, during typical use, a clip or magazine having a plurality of internal spaces used to accommodate bullets can be provided. If the clip or magazine is filled to capacity with ammunition, and the internal spaces are inaccessible to the insertion element (22) due to the presence of ammunition therein, a single bullet/round/cartridge can be removed from the magazine or clip to ensure that sufficient internal space exists to accommodate the insertion element (22). During typical use, the insertion element (22) can be laterally and/or longitudinally inserted (e.g., through a side opening) into the interior of a clip or magazine, without requiring significant compression thereof. In other embodiments, the insertion element (22) can be compressed (e.g., manually by a user), which narrows the width of the gap (24) to facilitate passage of the insertion element (22) through an exterior opening on the clip or magazine. The insertion element (22) can be permitted to expand, widening the gap (24) such that the first and second portions (25, 27) of the insertion element (22) contact an interior surface of the clip or magazine. Engagement between the holder (10) and a container for ammunition in this manner can prevent unintended disengagement and/or loss of a clip or magazine, as the insertion element (22) would normally require an external force applied by a user to compress the insertion element (22) to facilitate removal thereof from the interior space within a clip or magazine. For example, during typical use, to remove the clip or magazine from the holder (10), a user wearing the holder (via the clip (14)) could pull upward on the clip or magazine, which would compress the insertion element (22) to a diameter sufficiently small to pass through an exterior opening of the clip or magazine. In other embodiments, it may also be possible, if desired, for a user to move the clip or magazine in a lateral direction relative to the insertion element (22) to enable removal therefrom without requiring significant compression of the insertion element (22).

To further secure a clip or magazine within the holder (10), FIG. 1 depicts the first angle (26) between the first portion (12) and the second portion (16) as an acute angle (e.g., less than ninety degrees), while the second angle (28) between the insertable member (18) and the second portion (16) is shown as a right angle (e.g., approximately ninety degrees). As such, the insertable member (18) extends toward the first portion (12) (e.g., the longitudinal axes of the insertable member (18) and first portion (12) would intersect if extended upward). It should be readily understood that while FIG. 1 depicts the first angle (26) as an acute and the second angle (28) as a right angle, a configuration in which the insertable member (18) extends toward the first portion (12) could be achieved in a number of ways. For example, both the first and second angles (26, 28) could be acute, the first angle (26) could be a right angle while the second angle (28) is acute, or either of the angles (26, 28) could be obtuse (e.g., greater than ninety degrees), while the other angle (26, 28) could be acute, so long as the acute angle is smaller than ninety degrees by an amount greater than the difference between the obtuse angle and ninety degrees. In other embodiments, the insertable member (18) could have a shape that is curved and/or bent toward the first portion (12), independent of the angles between the portions of the holder (10).

As such, when the insertable member (18) is inserted into the interior of a clip or magazine, the orientation of the insertable member (18) toward the first portion (12) can apply a force that biases the clip or magazine against the first portion (12), creating friction therebetween. While the amount of friction created can vary depending on the angles (26, 28) of the holder (10), and the materials of the first portion (12), insertable member (18), and clip or magazine, in an embodiment, the friction between the first portion (12) and clip or magazine can be sufficient to retain the clip or magazine in a generally stationary orientation relative to the holder (10), even if the holder (10) is placed in other orientations (e.g., upside down). In such an embodiment, the holder (10) can be at least partially formed from a bendable material, such that a portion of the holder (10) can be manually deformed to reduce or eliminate contact between the clip or magazine and the first portion (12), facilitating the removal of the clip or magazine from the holder (10) unimpeded by friction therebetween. In an embodiment, the first portion (12) can include a frictional surface (e.g., a textured surface) and/or frictional materials (e.g., rubber) disposed thereon to increase frictional forces between the holder (10) and an engaged clip or magazine.

FIG. 2 depicts the holder (10) of FIG. 1 engaged with a container for ammunition, e.g., a magazine (30). Specifically, the magazine (30) includes an interior space (34) normally occupied by ammunition, and an exterior opening (32) through which the space (34) is accessible. As described previously, the depicted holder (10) includes a first portion (12) shown as a generally vertical plate, a second portion (16) extending from the first portion (12) at an acute angle, and an insertable member (18) extending from the second portion (16) at a right angle. The insertable member (18) includes an insertion element (22) at an end thereof, shown as a split-ring structure having a gap (24) within a circular and/or cylindrical member, such that the insertion element (22) can be compressed to a smaller diameter (narrowing the width of the gap (24)).

To engage the depicted holder (10) with the depicted magazine (30), the insertion element (22) can be laterally inserted through a side opening of the magazine (30), as described above, such that significant compression thereof is not necessary. In other embodiments, the insertion element (22) could be compressed to reduce the diameter thereof (e.g., by narrowing the width of the gap (24)), such that the insertion element (22) can pass through the exterior opening (32) in a bottom surface of the magazine. Once positioned within the interior space (34) of the magazine (30), the insertion element (22) can contact an interior surface thereof. Depending on the specific configuration of the magazine (30), the insertion element (22) could be permitted to expand to a larger diameter prior to contacting an interior surface of the space (34) (e.g., if the interior of the magazine has a width larger than that of the exterior opening therein), such that a force sufficient to compress the insertion element (22) would be necessary to disengage the holder (10) from the magazine (30). However, embodiments of the present holder are also usable with containers for ammunition having an interior space with a width equal to or smaller than that of an exterior opening therein. For example, friction between the insertion element and the interior of the magazine (30), which can be caused by the tendency of the insertion element (22) to expand in diameter causing the insertion element (22) to apply a force against the interior surface of the magazine (30), can resist disengagement of the holder (10) from the magazine (30) unless a user applies a manual force in excess of the friction to disengage the magazine (30). In an embodiment, the frictional forces generated between the magazine (30) and the insertion element (22) can exceed the gravitational force caused by the weight of the magazine (30) and/or other expected incidental forces to be applied to the magazine (30). For example, in such an embodiment, the holder (10) and magazine (30) could be inverted (e.g., oriented upside-down), and the frictional forces between the insertion element (22) and magazine (30) could prevent disengagement of the holder (10) from the magazine (30) caused by gravity due to the frictional forces exceeding the gravitational force on the magazine (30).

FIG. 2 also depicts the insertable member (18) extending toward the first portion (12) of the holder (10), e.g., due to at least one of the angles between the first and second portions (12, 16) and between the second portion (16) and the insertable member (18) being acute, such that contact between the insertion element (22) and the interior surface of the magazine (30) applies a lateral force in the direction of the first portion (12), thereby generating friction between the first portion (12) and the magazine (30) that further resists disengagement of the holder (10) from the magazine (30). In an embodiment, the frictional forces generated between the magazine (30) and the first portion (12) can exceed the gravitational force caused by the weight of the magazine (30) and/or other expected incidental forces to be applied to the magazine (30). For example, in such an embodiment, the holder (10) and magazine (30) could be inverted (e.g., oriented upside-down), and the frictional forces between the first portion (12) and the magazine (30) could prevent disengagement of the holder (10) from the magazine (30) caused by gravity due to the frictional forces exceeding the gravitational force on the magazine (30). In other embodiments, the combination of frictional forces between the magazine (30) and the first portion (12) and between the magazine (30) and the insertion element (22) could exceed the gravitational force caused by the weight of the magazine (30), such that a manual force (e.g., by a user) is typically necessary to disengage the magazine (30) from the holder (10).

Figure 3:
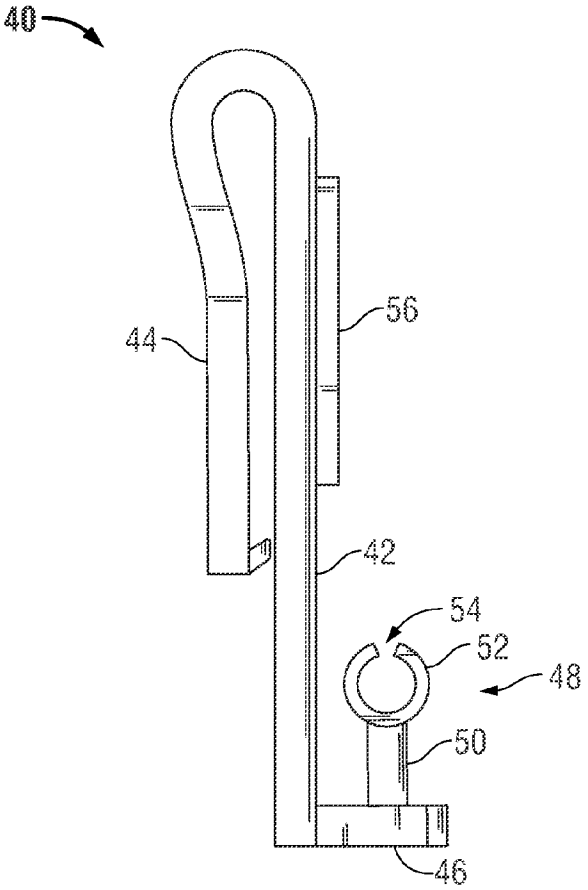
FIG. 3 depicts a diagrammatic side view of an alternate embodiment of a holder usable within the scope of the present disclosure.

FIG. 3 depicts a diagrammatic side view of an alternate embodiment of a holder (40) usable within the scope of the present disclosure. Similar to the holder shown in FIGS. 1 and 2, the depicted holder (40) includes a first portion (42) shown as a generally vertical plate or similar member with a clip (44) extending therefrom, e.g., for securing to an article of clothing of a user. A second portion (46), shown as a generally horizontal plate, extends from a lower end of the first portion (42), and an insertable member (48) having a spacing element (50) and insertion element (52) extends from the second portion (46). The insertion element (52) is depicted as a split-ring structure having a gap (54) therein, such that the insertion element (52) can be compressed to a smaller diameter (e.g., by narrowing the gap (54)) to enable passage of the insertion element (52) through an opening in a clip or magazine (e.g., when removing a magazine from the holder (40)). The depicted holder (40) further includes a protruding member (56) extending from the first portion (42). While embodiments usable within the scope of the present disclosure can include protruding members formed from any generally solid material, specific embodiments can include compressible materials formed from plastic, rubber, wood, metal, one or more polymers, one or more composites, or combinations thereof. During typical use, the protruding member (56) can be compressed by contact with a clip or magazine engaged with the insertable member (48), such that the tendency of the compressible member (56) to return to its original shape creates friction between the compressible member (56) and the clip or magazine to resist disengagement thereof from the holder (40). In other embodiments, contact between the protruding member (56) and a container for ammunition can generate sufficient frictional forces without necessitating compression thereof.

Figure 4:
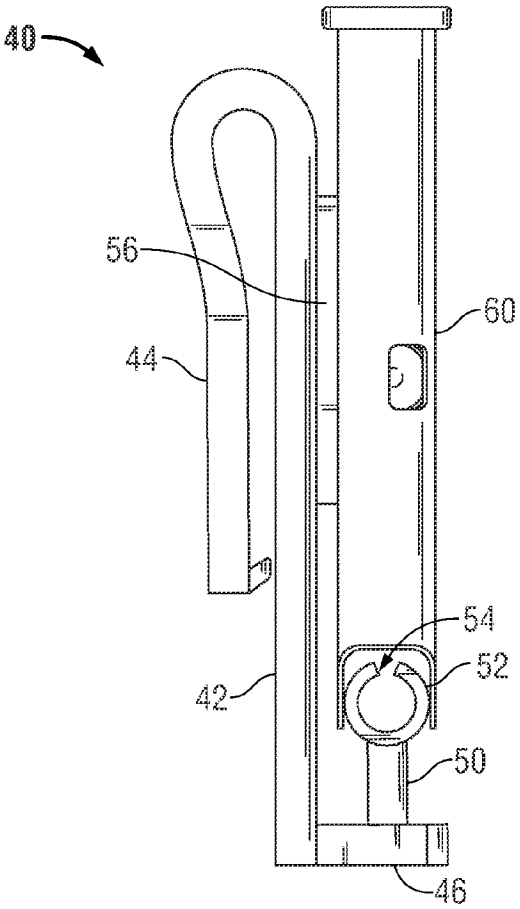
FIG. 4 depicts the holder of FIG. 3 engaged with a container for ammunition.

For example, FIG. 4 depicts a magazine (60) engaged with the holder (40). Specifically, the insertion element (52) and a portion of the spacing element (50) are shown positioned within the interior of the magazine (60), having been inserted therein (e.g., through lateral insertion of the insertion element (52) as described above, and/or through compression of the insertion element (52) to enable passage through an exterior opening in the magazine (60)). Engagement of the magazine (60) with the insertion element (52) positions the magazine against the protruding member (56), such that the protruding member (56) is at least partially compressed. As such, friction is created between the protruding member (56) and the magazine (60) to resist disengagement of the magazine (60) from the holder (40). In an embodiment, the frictional forces generated between the magazine (60) and the protruding member (56) can exceed the gravitational force caused by the weight of the magazine (60) and/or other expected incidental forces to be applied to the magazine (60). For example, in such an embodiment, the holder (40) and magazine (60) could be inverted (e.g., oriented upside-down), and the frictional forces between the compressible member (56) and the magazine (60) could prevent disengagement of the holder (40) from the magazine (60) caused by gravity due to the frictional forces exceeding the gravitational force on the magazine (60). In other embodiments, the combination of frictional forces between the magazine (60) and the protruding member (56) and between the magazine (60) and the insertion element (52) could exceed the gravitational force caused by the weight of the magazine (60), such that a manual force (e.g., by a user) is typically necessary to disengage the magazine (60) from the holder (40). In other embodiments, the engagement between the insertion element (52) and magazine (60) alone could be sufficient to prevent disengagement of the magazine (60) from the holder (40).

While FIGS. 3 and 4 depict the second portion (46) extending generally perpendicular to the first portion (42), and the insertable member (48) extending generally perpendicular to the second portion (46), it should be understood that the insertable member (48) could be positioned at an angle relative to the first portion (42), and extend toward the first portion (42) to generate friction between the magazine (60) and the first portion (42) and/or increase the friction between the magazine (60) and the protruding member (56), similar to the configuration of the holder shown in FIGS. 1 and 2. In a similar manner, while the embodiment of the holder shown in FIGS. 1 and 2 lacks a protruding member or similar feature, a protruding member could be used in combination with an insertable member that is angled toward the first portion of the holder.

Figure 5:
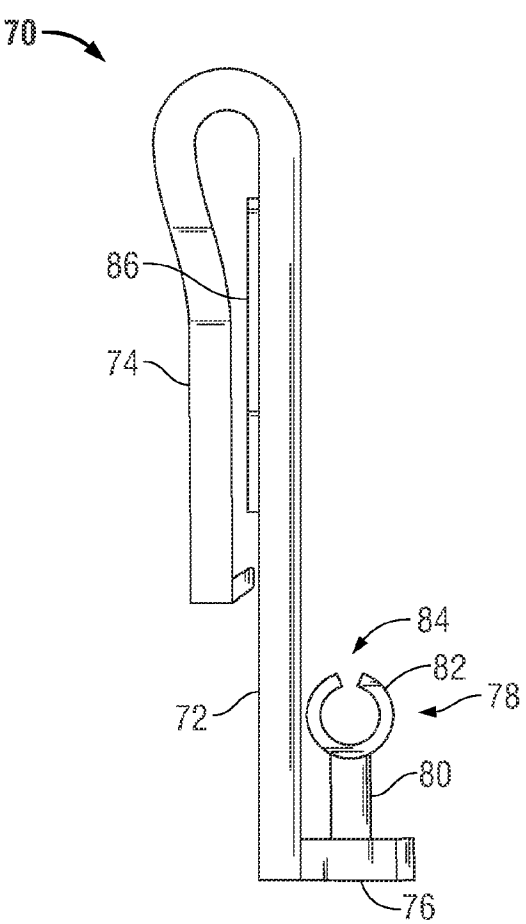
FIG. 5 depicts a diagrammatic side view of an alternate embodiment of a holder usable within the scope of the present disclosure.

FIG. 5 depicts a diagrammatic side view of an alternate embodiment of a holder (70) usable within the scope of the present disclosure. Similar to the holders shown in FIGS. 1 through 4, the depicted holder (70) includes a first portion (72) shown as a generally vertical plate or similar member, having a clip (74) extending therefrom (e.g., for securing the holder (70) to an article of clothing of a user). A second portion (76), shown as a generally horizontal plate or similar member, extends from the lower end of the first portion (72), and an insertable member (78), shown including a spacing element (80) and an insertion element (82) (depicted as a split-ring structure having a gap (84) therein), extends from the second portion (76). In the depicted embodiment, a ferromagnetic element, e.g., a magnet (86) is shown positioned on the side of the first portion (72) opposite the insertable member (78). It should be understood that while the magnet (86) is depicted in an exemplary location (e.g., the back-side of the first portion (72)), in various embodiments, one or more magnets could be embedded within the first portion (72), flush with the first portion (72), and/or extend from the front side of the first portion (72). During typical use, the magnet (86) can apply a force to a metallic clip or magazine (e.g., by attracting the clip or magazine), thereby drawing the clip or magazine against the first portion (72) to create friction therebetween. To enhance such frictional forces, the front side of the first portion (72) can include a frictional surface (e.g., a textured surface and/or a frictional material, such as rubber).

Figure 6:
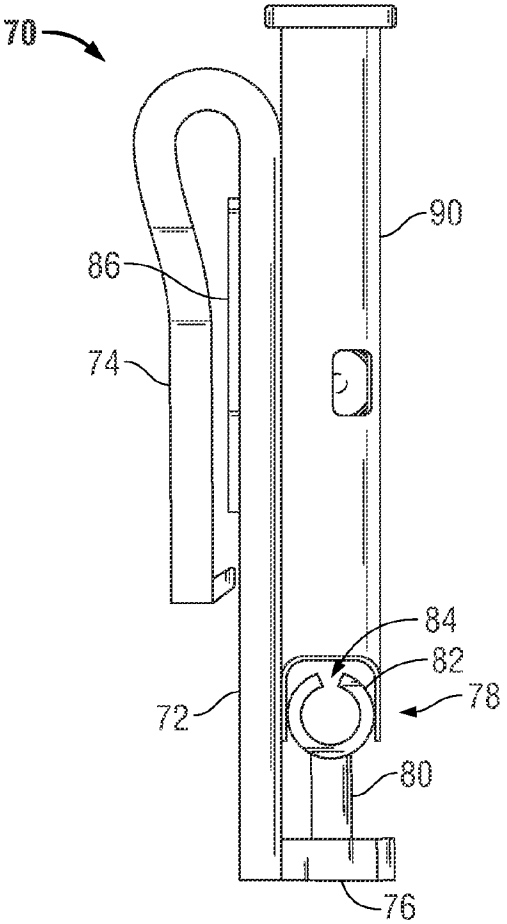
FIG. 6 depicts the holder of FIG. 5 engaged with a container for ammunition.

For example, FIG. 6 depicts a magazine (90) engaged with the holder (70). Specifically, the insertion element (82) and a portion of the spacing element (80) are shown positioned within the interior of the magazine (90), having been inserted therein (e.g., through lateral insertion of the insertion element (82) as described above, and/or through compression of the insertion element (82) to enable passage through an exterior opening in the magazine (90)). The engaged magazine (90) can be urged into contact with the first portion (72), e.g., via a force applied by the magnet (86). As such, friction is created between the first portion (72) and the magazine (90) to resist disengagement of the magazine (90) from the holder (70). In an embodiment, the frictional forces generated between the magazine (90) and the first portion (72) can exceed the gravitational force caused by the weight of the magazine (90) and/or other expected incidental forces to be applied to the magazine (90). For example, in such an embodiment, the holder (70) and magazine (90) could be inverted (e.g., oriented upside-down), and the frictional forces between the first portion (72) and the magazine (90) could prevent disengagement of the holder (70) from the magazine (90) caused by gravity due to the frictional forces exceeding the gravitational force on the magazine (90). In other embodiments, the combination of frictional forces between the magazine (90) and the first portion (72) and between the magazine (90) and the insertion element (82) could exceed the gravitational force caused by the weight of the magazine (90), such that a manual force (e.g., by a user) is typically necessary to disengage the magazine (90) from the holder (70). In other embodiments, the engagement between the insertion element (82) and magazine (90) alone could be sufficient to prevent disengagement of the magazine (90) from the holder (70).

While FIGS. 5 and 6 depict the second portion (76) extending generally perpendicular to the first portion (72), and the insertable member (78) extending generally perpendicular to the second portion (76), it should be understood that the insertable member (78) could be positioned at an angle relative to the first portion (72), and extend toward the first portion (72) to generate additional friction between the magazine (90) and the first portion (72), similar to the configuration of the holder shown in FIGS. 1 and 2. In a similar manner, while the holder shown in FIGS. 1 and 2 lacks a ferromagnetic element or similar feature, a ferromagnetic element could be used in combination with an insertable member that is angled toward the first portion of the holder. Further, while the holder shown in FIGS. 5 and 6 lacks a protruding member, such as that shown in FIGS. 3 and 4, a protruding member could be used with the embodiment of the holder (70) shown in FIGS. 5 and 6, and similarly, a magnet could be used with the embodiment of the holder shown in FIGS. 3 and 4. In brief summary, any of the configurations depicted and described herein for producing friction between a container for ammunition and a holder, and any other methods for creating such friction, can be used, alone or in combination with other configurations and/or methods, without departing from the scope of the present disclosure.

Figure 7:
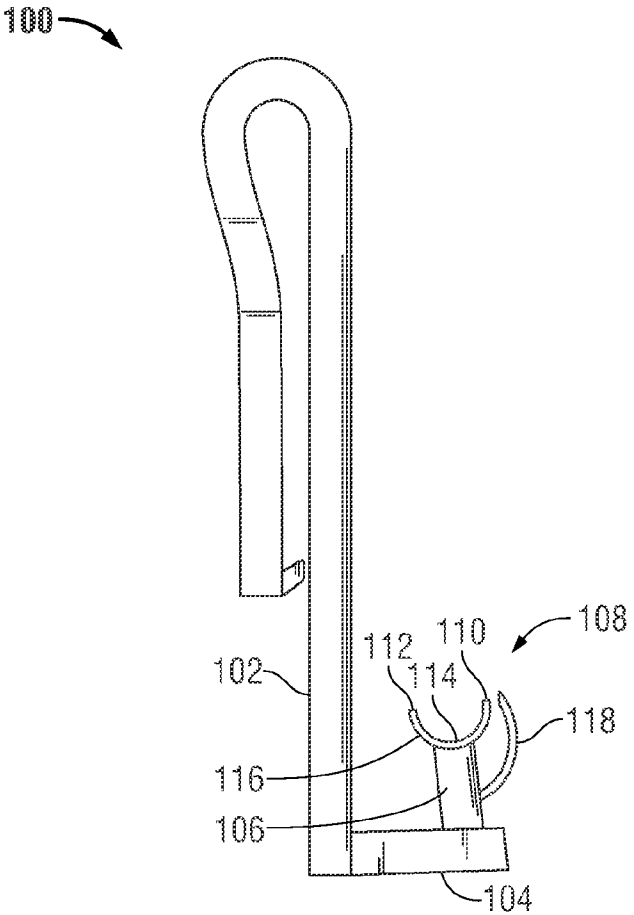
FIG. 7 depicts an alternate embodiment of a holder usable within the scope of the present disclosure.

FIG. 7 depicts a diagrammatic side view of an alternate embodiment of a holder (100) usable within the scope of the present disclosure. Similar to the holders shown in FIGS. 1 through 6, the depicted holder (100) includes a first portion (102), shown as a generally vertical plate or similar member, having a second portion (104), shown as a generally horizontal plate or similar member, extending therefrom. An insertable member is shown extending from the second portion (104) toward the first portion (102) (e.g., such that a clip or magazine into which the inserted member is inserted would be urged against the first portion (102) to create friction, as described with regard to, for example, the holder depicted in FIG. 1), the insertable member having a spacing element (106) and an insertion element (108). In the depicted embodiment, the insertion element (108) is shown as a curved member (e.g., having a semicircular shape and/or a "U" shape), having two ends (110, 112) with a space therebetween, an interior surface (114), and an exterior surface (116). In use, the width (e.g., the distance between the ends (110, 112)) of the insertion element (108) can be reduced by compressing the insertion element (108) to enable passage thereof through an opening in a clip or magazine (e.g., when removing a clip or magazine therefrom). FIG. 7 further depicts a brace (118) extending from the insertable member, which can contact and/or stabilize a secured clip or magazine to prevent pivoting and/or rotation thereof away from the first portion (102). The brace (118) can be flexible and/or adjustable for accommodating containers for ammunition having any dimensions and/or external features, and in various embodiments, could be omitted (e.g., if the engagement between the insertable member and a clip or magazine is sufficient to retain the clip or magazine in contact with the first portion (102)).

Figure 8:
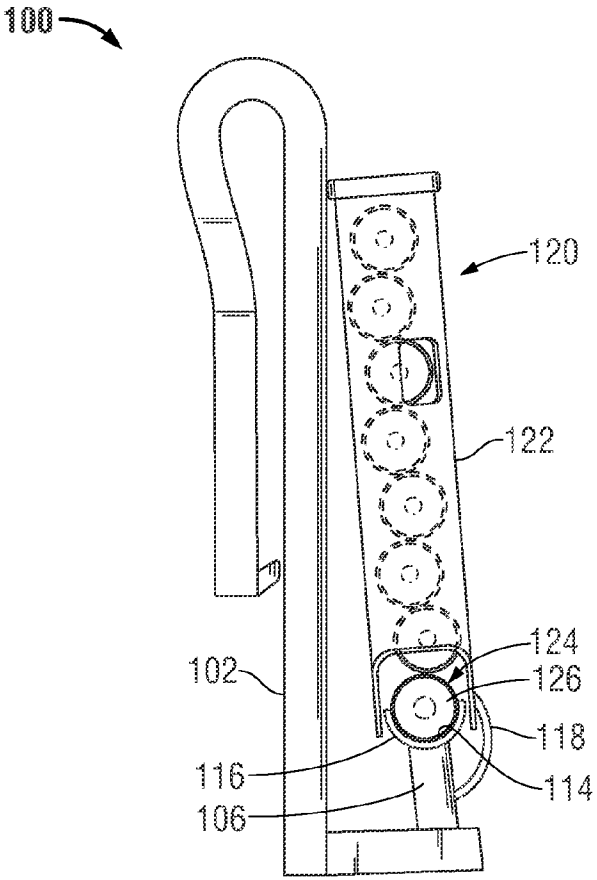
FIG. 8 depicts the holder of FIG. 7 engaged with a container for ammunition.

For example, FIG. 8 depicts a magazine (120) engaged with the holder (100). Specifically, the insertion element is shown positioned within the interior (124) of the magazine (120), having been inserted therein (e.g., through lateral insertion, as described above, and/or through compression of the insertion element). The engaged magazine (120) can be urged into contact with the first portion (102), e.g., via the relative angles between the first and second portions (102, 104) and/or between the second portion (104) and the insertable member, which causes the insertable member to extend toward the first portion (102). In various embodiments, the depicted holder (100) can include a protruding member, a ferromagnetic element, and/or a frictional surface, as described previously with regard to other depicted embodiments. In such embodiments, use of acute angles between one or more of the insertable member, the first portion (102), and the second portion (104) could potentially be omitted. In brief summary, any of the configurations depicted and described herein for producing friction between a container for ammunition and a holder, and any other methods for creating such friction, can be used, alone or in combination with other configurations and/or methods, without departing from the scope of the present disclosure.

As such, friction is created between the first portion (102) and the magazine (120) to resist disengagement thereof from the holder (100). In an embodiment, the frictional forces generated between the magazine (120) and the first portion (102) can exceed the gravitational force caused by the weight of the magazine (120) and/or other expected incidental forces to be applied to the magazine (120). For example, in such an embodiment, the holder (100) and magazine (120) could be inverted (e.g., oriented upside-down), and the frictional forces between the first portion (102) and the magazine (120) could prevent disengagement of the holder (100) from the magazine (120) caused by gravity due to the frictional forces exceeding the gravitational force on the magazine (120). In other embodiments, the combination of frictional forces between the magazine (120) and the first portion (102) and between the magazine (120) and the insertion element (108) could exceed the gravitational force caused by the weight of the magazine (120), such that a manual force (e.g., by a user) is typically necessary to disengage the magazine (120) from the holder (100). In other embodiments, the engagement between the insertion element (108) and magazine (120) alone could be sufficient to prevent disengagement of the magazine (120) from the holder (100).

In the depicted embodiment, the shape of the insertion element (108) enables the insertion element to simultaneously occupy an interior space (124) of the magazine (120) that is occupied by a bullet (126). While the exterior surface (116) of the insertion element (108) can contact an interior surface of the magazine (120), the shape of the interior surface (114) of the insertion element (108) can accommodate the position of the bullet (126), such that both the insertion element (108) and the bullet (126) can simultaneously occupy the interior space (124), without requiring removal of the bullet (126) to accommodate placement of the insertion element (108). The brace (118) is shown in contact with an external surface (122) of the magazine (120) to prevent rotating and or pivoting thereof relative to the first portion (102), thereby facilitating retention of contact therebetween.

Thus, embodiments described herein relate to holders for containers for ammunition, and related methods, usable as "universal" holders for securing multiple types of clips, magazines, and/or similar containers for ammunition, that can be used to engage the interior of a container for magazine, thereby enabling a reduction in bulk, cost, materials, and manufacturing time, while facilitating concealment and wearing of the holder in a variety of orientations. The secure engagement of a container for ammunition with an embodied holder can be enhanced through the creation of friction between the container for ammunition and a portion of the holder.

While various embodiments usable within the scope of the present disclosure have been described with emphasis, it should be understood that within the scope of the appended claims, the present invention can be practiced other than as specifically described herein.

What is claimed is:

1. A holder for retaining a container for ammunition, the holder comprising:

a first portion configured for attachment to a surface, the first portion including a longitudinal axis;

a second portion extending from the first portion at a first angle; and an insertable member extending from the second portion at a second angle, wherein the insertable member is adapted for insertion into an interior of the container for ammunition to create friction between the container for ammunition and the holder for preventing relative movement between the container for ammunition and the holder, the insertable member including a first curved member, a second curved member, and a bridging section connecting the first curved member to the second curved member to define an at least partially cylindrical shape that includes a gap in a circumference thereof, wherein no structure other than the bridging section connects the first curved member to the second curved member, wherein at least one of the first curved member or the second curved member is movable relative to the other of the first curved member or the second curved member to provide the insertable member with a first dimension configured for passage into the container for ammunition, and wherein movement of at least one of the first curved member or the second curved member narrows a width of the gap.

2. The holder of claim 1, wherein the first angle is acute and the second angle is ninety degrees or greater.

3. The holder of claim 1, wherein the second angle is ninety degrees or greater.

4. The holder of claim 1, wherein the first portion, the second portion, the insertable member, or combinations thereof is at least partially formed from a bendable material for facilitating bending of at least a portion of the holder to facilitate insertion of the insertable member into the interior of the container for ammunition.

5. The holder of claim 1, wherein the first portion comprises a fastener adapted for securing to an article of clothing.

6. The holder of claim 1, wherein the insertable member further includes a spacing element coupled to the second portion and to one or more of the first curved member, the second curved member, or the curved section, the spacing element including a length configured to space the container for ammunition a distance from the second portion.

7. The holder of claim 1, wherein the first curved member and the second curved member define a space therebetween, and wherein movement of the at least one of the first curved member or the second curved member changes a width of the space to compress and expand the insertable member between the first dimension configured for passage into the container for ammunition and a second dimension larger than the first dimension, wherein the second dimension is configured for contacting an interior of the container for ammunition.

8. The holder of claim 1, wherein the insertable member includes a semi-circular cross-sectional shape having a first end associated with the first curved member and a second end associated with the second curved member, a space being defined between the first end and the second end, wherein movement of the at least one of the first curved member or the second curved member changes a width of the space to compress and expand the insertable member to a plurality of dimensions equal to or larger than the first dimension configured for passage into the container for ammunition.

9. The holder of claim 1, wherein the central axis of the at least partially cylindrical shape is parallel to the second portion.

10. A holder for retaining a container for ammunition, the holder comprising:

a first portion configured for attachment to a surface;

a second portion extending from the first portion at a first angle; and an insertable member extending from the second portion at a second angle, wherein the insertable member is adapted for insertion into an interior of the container for ammunition to engage the container for ammunition, the insertable member including a curved member having a first end and a second end with a first distance between the first end and the second end, there being no structure other than the curved member connecting the first end to the second end, wherein at least one of the first end or the second end is movable to change the first distance to a second distance less than the first distance.

11. The holder of claim 10, wherein the first portion, the second portion, the insertable member, or combinations thereof is at least partially formed from a bendable material for facilitating bending of at least a portion of the holder to facilitate insertion of the insertable member into the interior of the container for ammunition.

12. The holder of claim 10, wherein the first portion comprises a fastener adapted for securing to an article of clothing.

13. The holder of claim 10, wherein the curved member includes a convex surface facing the second portion and a concave surface opposite the convex surface, and wherein contact with the convex surface is configured to cause movement of the one or more of the first end or the second end.

14. The holder of claim 10, wherein the curved member includes a semi-circular cross-sectional shape.

15. The holder of claim 10, wherein the curved member includes a circular cross-sectional shape having a gap in a circumference thereof, and wherein movement of one of the first end or the second end narrows a width of the gap.

16. The holder of claim 10, wherein the curved member includes one or more of a cylindrical or semi-cylindrical shape having a central axis perpendicular to a longitudinal axis of the first portion and parallel to the second portion.

17. The holder of claim 10, wherein the curved member includes an exterior surface adapted for contacting the interior of the container for ammunition, and an interior surface, the curved member being biased toward separation of the first end and the second end by the first distance.

18. A holder for retaining a container for ammunition, the holder comprising:

a first portion configured for attachment to a surface, the first portion having a longitudinal axis;

a second portion extending from the first portion at a first angle; and an insertable member extending from the second portion at a second angle, wherein the insertable member is adapted for insertion into an interior of the container for ammunition to engage the container for ammunition, the insertable member including one or more of a cylindrical or semi-cylindrical shape having a base facing the second portion, a first end opposite the base, and a second end opposite the base and laterally offset from the first end, one of the first end or the second end being movable to narrow a width of a gap between the first end and the second end, wherein no structure other than the base connects the first end to the second end.

19. The holder of claim 18, further comprising a frictional surface on the first portion, the frictional surface being adapted to contact the container for ammunition to prevent relative movement between the first portion and the container for ammunition.

20. The holder of claim 18, wherein the first portion, the second portion, the insertable member, or combinations thereof is at least partially formed from a bendable material for facilitating bending of at least a portion of the holder to facilitate insertion of the insertable member into the interior of the container for ammunition.

21. The holder of claim 18, wherein the first portion comprises a fastener adapted for securing to an article of clothing.

22. The holder of claim 18, wherein movement of the first end relative to the second end reduces at least one dimension of the insertable member.

23. The holder of claim 18, wherein the insertable member includes a curved shape that is compressible and expandable between a first dimension adapted for passage through an opening in an exterior of the container for ammunition and a second dimension larger than the first dimension and adapted for contacting the interior of the container for ammunition.

24. The holder of claim 18, wherein the insertable member includes a curved shape.

25. The holder of claim 18, further comprising a spacing member coupled to a base of the insertable member and to the second portion, wherein the spacing member includes a height configured to space the container for ammunition at a selected position along a length of the first portion.

26. The holder of claim 18, wherein the insertable member includes an exterior surface facing the second portion and adapted for contacting the interior of the container for ammunition, and an interior surface opposite the exterior surface and adapted to accommodate ammunition within the interior of the container for ammunition, and wherein contact with the exterior surface is configured to move one or more of the first end or the second end closer to the other of the first end or the second end.

27. A holder comprising:

a first plate;

a second plate extending from the first plate at a first angle; and an insertable member extending from the second plate at a second angle, the insertable member having a body with a curved base and a first end and a second end spaced from the first end to define a gap between the first end and the second end, wherein no structure other than the base of the body connects the first end to the second end, and wherein at least a portion of the insertable member is movable between a first position adapted for passage through an opening in an exterior of an object and a second position having at least one dimension larger than a dimension of the first position.

28. The holder of claim 27, wherein the insertable member includes a central axis parallel to the second plate.

29. The holder of claim 27, wherein the insertable member includes a central axis perpendicular to a longitudinal axis of the first plate.

30. The holder of claim 27, wherein the second plate is perpendicular to the first plate.

31. The holder of claim 27, wherein the at least a portion of the insertable member comprises an open upper end and a closed lower end facing the second plate.

32. The holder of claim 27, wherein movement of the insertable member toward the first position moves one or more of: the first end toward the second end or the second end toward the first end.

33. The holder of claim 27, wherein the at least a portion of the insertable member is movable between a plurality of intermediate positions having at least one dimension larger than the dimension of the first position and smaller than a dimension of the second position.

34. The holder of claim 27, wherein movement of the at least a portion of the insertable member between the first position and the second position changes a width of the gap.

35. The holder of claim 27, wherein the first plate comprises a first face and a second face opposite the first face, wherein the second plate extends from the first face, the holder further comprising a fastener adapted for securing to a surface extending from the second face.

36. The holder of claim 27, wherein the first plate comprises a first end and a second end opposite the first end, wherein the second plate extends from the first end, the holder further comprising a fastener adapted for securing to a surface extending from the second end.

37. The holder of claim 27, further comprising a spacing element positioned between the at least a portion of the insertable element and the second plate.

* * * * *